US009193506B2

(12) United States Patent
Madison et al.

(10) Patent No.: US 9,193,506 B2
(45) Date of Patent: Nov. 24, 2015

(54) HAIR COLOR BOTTLE

(75) Inventors: Kathryn Madison, Portland, OR (US); Monte Cook, Portland, OR (US)

(73) Assignee: Kathryn Madison, Portland, OR (US)

( * ) Notice: Subject to any disclaimer, the term of this patent is extended or adjusted under 35 U.S.C. 154(b) by 0 days.

(21) Appl. No.: 13/195,744

(22) Filed: Aug. 1, 2011

(65) Prior Publication Data

US 2014/0110438 A1 Apr. 24, 2014

(51) Int. Cl.

| | |
|---|---|
| ***B65D 37/00*** | (2006.01) |
| ***B65D 47/06*** | (2006.01) |
| ***B65D 47/32*** | (2006.01) |
| ***A45D 19/02*** | (2006.01) |
| ***B65D 47/20*** | (2006.01) |

(52) U.S. Cl.

CPC ..... *B65D 47/06* (2013.01); *A45D 19/02* (2013.01); *B65D 47/2031* (2013.01); *B65D 47/32* (2013.01); *A45D 2200/056* (2013.01)

(58) Field of Classification Search

CPC ..... B65D 47/06; B65D 47/32; A45D 19/02
USPC ..... 222/211–213, 215, 206, 562, 1, 464.1, 222/568

See application file for complete search history.

(56) References Cited

U.S. PATENT DOCUMENTS

| | | | | |
|---|---|---|---|---|
| 281,606 | A | 7/1883 | Browne | |
| 3,878,962 | A * | 4/1975 | Holbrook et al. | 215/309 |
| 4,000,829 | A * | 1/1977 | Johnson et al. | 220/265 |
| 4,133,457 | A | 1/1979 | Klassen | |
| 4,186,882 | A * | 2/1980 | Szczepanski | 239/327 |
| 4,408,702 | A | 10/1983 | Horvath | |
| 4,474,314 | A | 10/1984 | Roggenburg, Jr. | |
| 4,700,861 | A * | 10/1987 | Neward | 215/309 |
| 4,747,518 | A | 5/1988 | Laauwe | |
| 5,025,955 | A * | 6/1991 | Stenger | 222/82 |
| 5,048,705 | A * | 9/1991 | Lynd et al. | 215/388 |

(Continued)

FOREIGN PATENT DOCUMENTS

| | | | |
|---|---|---|---|
| CN | 2249214 | Y | 3/1997 |
| CN | 1276767 | A | 12/2000 |

(Continued)

OTHER PUBLICATIONS

International Search Report and Written Opinion, for International Application No. PCT/US2012/049159, mailed Nov. 1, 2012, 6 pgs.

(Continued)

*Primary Examiner* — Paul R Durand
*Assistant Examiner* — Jeremy W Carroll
(74) *Attorney, Agent, or Firm* — Klarquist Sparkman, LLP

(57) ABSTRACT

A hair color delivery system includes a flexible bottle, a dispensing cap having a tapered nozzle, an asymmetric bi-directional valve assembly, and a dispensing tube. The valve assembly comprises a platform, and a pair of valves, comprising tapered extensions through which fluid may be expelled from the bottle and ambient air may enter the bottle. The valves are offset from each other so that they are not co-axial or rotationally symmetric. The delivery system enables a method of substantially continuous delivery of a fluid chemical, yielding a hair treatment that it is easy and safe to use in which the tapered nozzle stays fully charged with product as air can be admitted to a dispensing bottle through a different valve than that used for dispensing.

14 Claims, 9 Drawing Sheets

(56) References Cited

U.S. PATENT DOCUMENTS

| | | | | |
|---|---|---|---|---|
| 5,125,543 | A * | 6/1992 | Rohrabacher et al. | 222/211 |
| 5,219,102 | A * | 6/1993 | Wright | 222/190 |
| 5,477,994 | A * | 12/1995 | Feer et al. | 222/484 |
| 5,529,223 | A * | 6/1996 | Fisher | 222/211 |
| 5,746,348 | A | 5/1998 | Bloom | |
| 6,131,775 | A * | 10/2000 | Brody | 222/211 |
| 6,652,495 | B1 * | 11/2003 | Walker | 604/319 |
| 2005/0184075 | A1 * | 8/2005 | Belcastro | 220/714 |
| 2008/0093387 | A1 | 4/2008 | Pivonka et al. | |
| 2010/0133293 | A1 * | 6/2010 | Ziesel | 222/1 |

FOREIGN PATENT DOCUMENTS

| | | | |
|---|---|---|---|
| CN | 1279601 | A | 1/2001 |
| CN | 2692081 | Y | 4/2005 |
| DE | 102008050925 | A1 | 4/2010 |
| KR | 960012805 | B1 | 9/1996 |
| RU | 98093 | U1 | 10/2010 |
| WO | WO 2008/051894 | A2 | 5/2008 |
| WO | WO 2012/027768 | A1 | 3/2012 |

OTHER PUBLICATIONS

Extended European Search Report dated Feb. 11, 2015, from corresponding European Patent Application No. 12820256.1 (6 pages).

First Office Action dated Dec. 23, 2014, from related Chinese Patent Application No. 201280047905.3 (11 pages, with English-language translation).

* cited by examiner

HAIR COLOR BOTTLE

FIELD

The disclosure pertains to devices and methods for storing and dispensing fluids. More particularly, the disclosure pertains to a flexible hair color bottle for mixing and applying fluid hair color chemicals using an asymmetric, bi-directional valve assembly.

BACKGROUND

The success of a hair color treatment depends on safe and controlled application of chemical dyes in a timely manner. Such chemical dyes, especially fluids, or those that contain volatile components such as solvents, may be allergenic, irritating, or even toxic if handled incorrectly. In addition, chemical dyes of the type used in hair color products can leave permanent stains if they are spilled on clothing, furniture, countertops, or floors. Moreover, skin can become stained or irritated if the color is allowed to make contact with bare skin for prolonged periods.

Hair color products are typically packaged with detailed application instructions, but it is often left up to the professional hair colorist to assemble the necessary tools for applying the product safely and consistently. For example, some instructions direct the user of the product to mix chemicals in a glass or plastic container, and to apply the chemical with a brush. If an open container such as a color bowl is used, product may be lost to evaporation and the resulting fumes may be unpleasant or even unsafe. Hair products intended for consumers are generally packaged with a color bottle or other application tools along with hair color (dye) and developer (peroxide). Consumers at home may be supplied a brush that is attached to the hair bottle to create lighter streaks in the hair or to retouch grey roots. While application with a brush typically permits better control and is appropriate for salon applications, brush application is difficult for consumers and home users of hair color almost always use a bottle having a short cone for product delivery.

The success of a hair color treatment relies on the precision of the application to the areas of the hair one desires and the speed at which one can apply the color. The color/dye is stored in a separate container from the developer/peroxide which activates the color when the two are mixed together. The dye and peroxide solutions are mixed immediately before application and as soon as the developer and color are mixed, a chemical process begins that changes the quality of the finished product. As the mixed product ages, it becomes more oxidized and less effective. In products intended to lighten hair color, the capability of the product to lighten decreases as the mixed product ages. Products intended to darken hair color, produce darker, muddier, and less attractive hair color as the mixed product ages. Consequently, the speed at which the product is applied can determine the quality of the resulting hair color. The degradation of the dye/peroxide mixture is especially problematic for home consumers who typically must rapidly, accurately, and uniformly apply the mixture to their own hair to produce satisfactory results.

Some hair color products are shipped with a small squeeze bottle having a screw cap closure with a simple cone-shaped nozzle that must be inverted to apply the product. Such a method of delivery is cumbersome for self-use, slows the delivery process, and is prone to leakage and spills. Furthermore, after initially squeezing the bottle, and upon release of manual pressure, a one-way nozzle tends to suck product back into the bottle while the air pressure is equilibrating, thus interrupting continuous flow of product during application. Also, in the case of fluids of higher viscosity or gels, some product inevitably remains in the bottom of the bottle and is wasted.

In general, fluid chemicals such as cleaning fluids or laboratory chemicals are often packaged and sold in, or may be mixed and stored by a user in, flexible squeeze bottles made from a soft, high density polyethylene. Some laboratory squeeze bottles have a wide mouth that is easy to fill, and that is covered by a screw cap having a conical tapered polypropylene nozzle coupled to a tube (pickup tube) that extends into the fluid reservoir. The tapered nozzle provides a simple way either to control the application of fluid chemical, or to use the chemical as a wash. The user controls the amount of fluid dispensed by simply squeezing the flexible bottle. Such bottles are, however, prone to dripping and chemical evaporation in response to changes in ambient air temperature and barometric pressure. Also, they must be maintained in an upright position, or the fluid will simply spill out of the dispensing cap. What is needed for safe and effective application of hair color products is a hair color delivery system suitable for mixing and storing the product in a closed container, and for applying the hair color in a continuous and controlled manner in either a salon setting or at home.

Existing vented squeeze bottle valves (for example, annular valves of the type commonly used for sports drinks or condiments) typically exhibit axial or rotational symmetry so that outside air passes through the cap around the perimeter of the dispenser as fluid chemical is squeezed out of the dispenser. Conventional dispensing bottles include those disclosed in U.S. Pat. No. 5,125,543 to Rohrbacher, U.S. Pat. No. 4,133,457 to Klassen, and U.S. Pat. No. 4,408,702 to Horvath, U.S. Pat. No. 4,474,314 to Roggenburg and U.S. Pat. No. 4,747,518 to Laauwe.

SUMMARY

The present disclosure concerns hair color bottled equipped with dispensing caps containing a bi-directional valve assembly that lacks axial or rotational symmetry. A hair color delivery system includes a flexible bottle, a dispensing cap having a tapered nozzle, an asymmetric bi-directional valve assembly situated between the flexible bottle and the dispensing cap, and a tube having a proximal end coupled to the valve and a distal end that extends into the flexible bottle. The dispensing cap is secured to the mouth of, and preferably seals, the flexible bottle, for example, by a threaded closure and using a portion of the valve assembly as a gasket situated between the bottle mouth and the dispensing cap.

According to some examples, asymmetric bi-directional valve assemblies used to dispense fluid from within a container include a platform for covering an opening to the container, an exit valve comprising a first tapered extension in the platform, and a first aperture through which fluid may be expelled from the container in an outward direction along a first axis, and an input valve comprising a second tapered extension in the platform, preferably opposing the first tapered extension, and a second aperture through which ambient air may enter the container in an inward direction along a second axis. The first and second axes are offset, or spaced apart, from each other, so that the valves are not co-axial. The tapered extensions are preferably in the shape of circular or flattened cones, having top openings that may be circular or linear slits, respectively.

Representative methods of substantially continuous delivery of a fluid to a target area include the steps of providing a flexible bottle, at least partially filling the flexible bottle with the fluid, expelling fluid from the flexible bottle, in response to application of external pressure on the flexible bottle by directing the fluid through a first tapered extension, dispensing the fluid to the target area through a tapered nozzle, and permitting air to enter into the flexible bottle through a second tapered extension spaced apart from, and opposing, the first tapered extension, so as to adjust internal and external pressures on the flexible bottle, thereby maintaining a supply of fluid in the tapered nozzle. When the fluid is a hair coloring agent, delivery of the coloring agent as disclosed results in a safe and effective hair color treatment.

There are many advantages of the disclosed methods and the disclosed systems. For example, it is easy and safe to accurately self-apply the hair color, while holding the bottle upright to reduce the chance of drips or spills. The tapered nozzle stays fully charged with product because, due to the bi-directional valve assembly, the tapered nozzle does not admit air when pressure is removed from the bottle. An opaque, closed bottle protects chemical from light and evaporation, and has a stylish appearance for use in salons. Such a bottle also protects the color product from exposure to air. A tapered nozzle also acts to cleanly part the hair, and may be used to spread the product along hair shafts. In other examples, transparent or translucent materials are used. Finally, the tube ensures that chemical remaining at the bottom of the bottle is accessible, to reduce waste.

The foregoing and other features, and advantages of the invention will become more apparent from the following detailed description, which proceeds with reference to the accompanying figures.

DETAILED DESCRIPTION

As used in this application and in the claims, the singular forms "a," "an," and "the" include the plural forms unless the context clearly dictates otherwise. Additionally, the term "includes" means "comprises." Further, the term "coupled" does not exclude the presence of intermediate elements between the coupled items.

The disclosed systems, devices and methods described herein should not be construed as limiting in any way. Instead, the present disclosure is directed toward all novel and non-obvious features and aspects of the various disclosed embodiments, alone and in various combinations and sub-combinations with one another. The disclosed systems, devices, and methods are not limited to any specific aspect or feature or combinations thereof, nor do the disclosed systems, devices, or methods require that any one or more specific advantages be present or problems be solved. Any theories of operation are to facilitate explanation, but the disclosed systems, devices, and methods are not limited to such theories of operation. The disclosed hair color delivery system is furthermore not limited to use with hair color chemical or health and beauty products. The terms "fluid," "chemical," "hair color," and "coloring agent" are meant to encompass fluids, water, mixtures, gels, slurries, pastes, and other flowing substances that may be ejected from a container by means of pressurization. The examples below are described with reference to hair colorants, but the disclosed apparatus can be used to dispense other materials as well.

According to some examples disclosed herein, a color bottle is provided for use as held in an upright position. Such an upright bottle can allow the person applying hair treatment products greater visibility and access to hard to reach areas, permitting easier application. Constant flow of color product through a delivery nozzle can provide consistent product flow, permitting more precise application. A two-way valve allows product to be applied more quickly with better results because there is no pause to allow air to depart from the chamber that retains the color product. A long tapered nozzle allows the user to cleanly part the hair before squeezing the color along the root line, and reach difficult areas more readily. In addition, the shaft of the nozzle may also be used as a tool to spread the product along the hair shaft. With such color bottles, the average home consumer may be able to reduce application time on their hair color and achieve greater accuracy. Because the color product can be less oxidized with the improved application speed that the disclosed methods and apparatus can provide, hair color results can be improved. More measured, precise application also reduces product dripping and mess, providing a more satisfactory consumer experience. The examples below pertain to a color bottle with a single nozzle assembly, but additional nozzles (such as interchangeable nozzles) can be provided as well.

Figure 1:
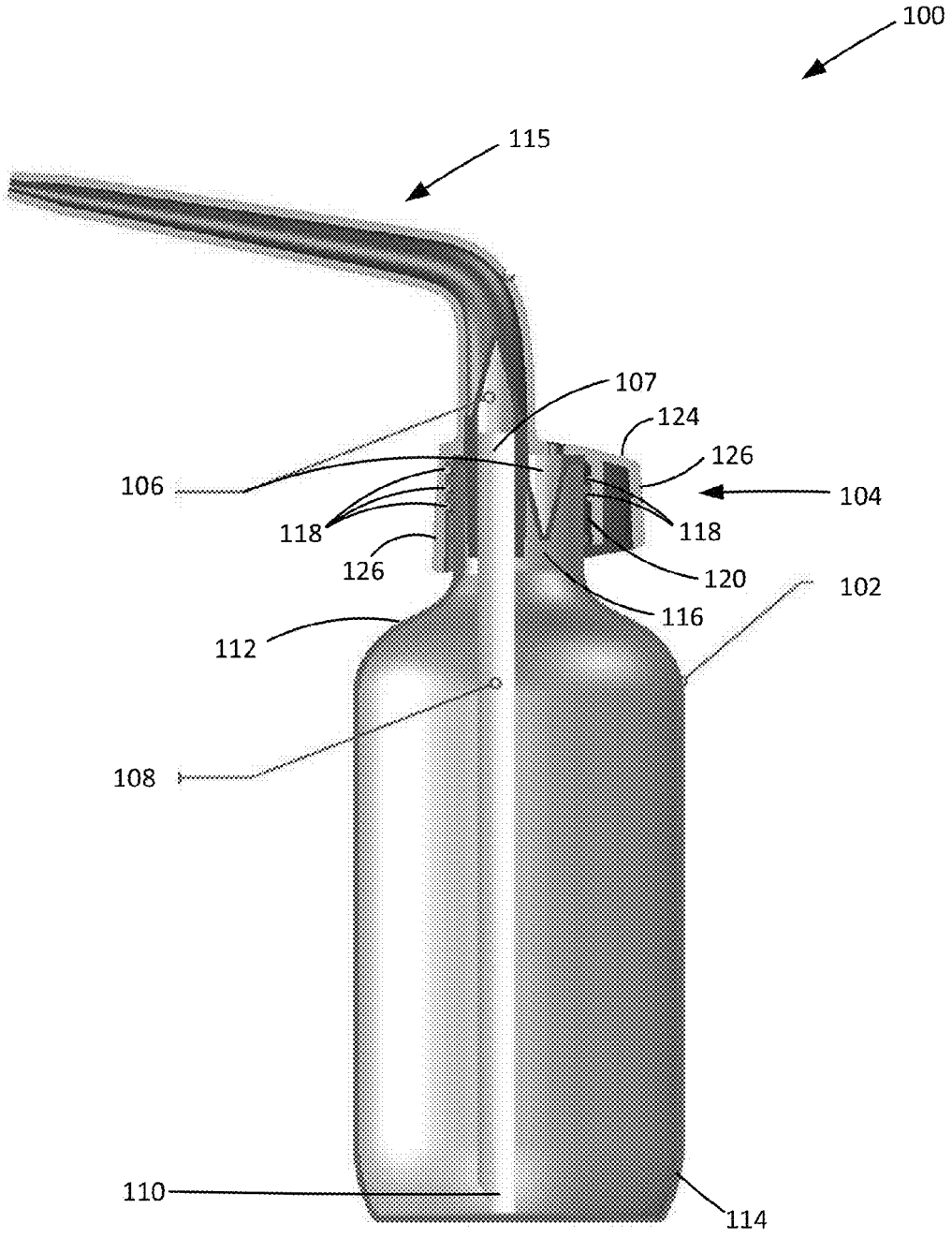
FIG. 1 is a pictorial side elevation view of a stylized representative example of a hair color bottle showing interior parts, including a hollow dispensing tube, a dispensing screw cap assembly that includes a tapered nozzle, and an asymmetric bi-directional valve assembly.
Figure 2:
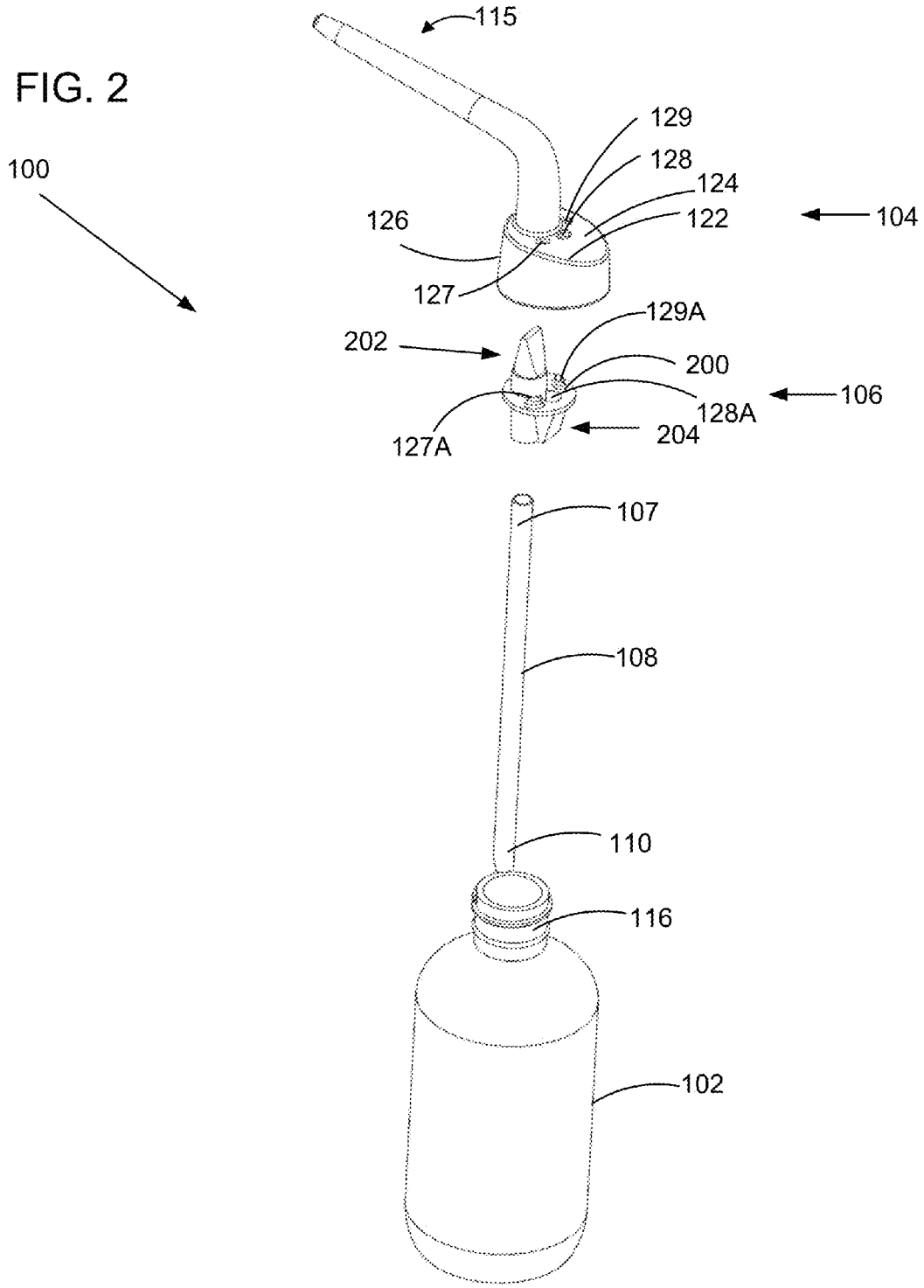
FIG. 2 is an exploded view of the hair color bottle of FIG. 1.

With reference to FIGS. 1-2, a representative example of a stylized hair color delivery system 100 is configured to facilitate directing and controlling the application of hair color products. Delivery system 100 comprises a flexible bottle 102, a dispensing screw cap assembly 104, and an asymmetric bi-directional valve assembly 106 that attaches to a proximal end 107 of a hollow delivery tube 108 having a distal end 110 that extends into the bottle 102. According to a representative example, the bottle 102 has a circularly cylindrical shape that may feature tapered shoulders 112 and a tapered base 114. However, the shape of the bottle 102 generally does not influence utility of the delivery system 100 and therefore containers such as the bottle 102 can be provided in arbitrary shapes. Embodiments of the bottle 102 are characterized by their flexibility, and in particular their elastic flexibility, so that when the bottle 102 is deformed by application of external pressure, the bottle 102 recovers from the compression and can return to an original shape, or at least partially return towards an initial shape or volume. Suitable elastic materials for the bottle 102 include but are not limited to low-density polyethylene-type materials commonly used for squeeze bottles. The volume capacity of the bottle 102 may reasonably be, but is not limited to, a range of volumes up to about 1 liter, wherein smaller bottles might preferably be packaged with hair color products for end user consumers, and larger bottles might preferably be sold to professional colorists or salons. Unlike conventional chemical wash bottles that are typically transparent or translucent, stylized hair color bottle 102 is preferably opaque, and available in a variety of designer colors and textures, with or without labels or indicia. However, the bottle 102 can be transparent or translucent.

Dispensing screw cap assembly 104 preferably features a tapered nozzle 115 for directing the release of hair color chemical contained in the bottle 102 and is configured to be coupled to the dispensing tube 108. The tapered nozzle 115 is shown as part of the screw cap assembly and can be formed in a molding process with other portions of the screw cap assembly 104, but in other examples, the tapered nozzle 115 can be a separate piece that is secured to the screw cap assembly 104. The bottle 102 preferably has a threaded mouth 116 for accommodating corresponding threads 118 on the screw cap assembly 104. The bottle mouth 116 has a circular cross section that fits the interior threads 118 that can be molded into an inside surface 120 of the screw cap assembly 104. The screw cap assembly 104 may have an outer perimeter 122 of arbitrary shape, for example, egg-shaped as shown in FIG. 2. Furthermore, the top surface 124 of the screw cap assembly 104 may be horizontal or tilted from horizontal with the bottle 102 in an upright position, and sides 126 of the screw cap assembly 104 may be vertical or tilted with the bottle 102 in an upright position, and the sides 126 can be straight or curved. As shown in FIG. 2, apertures 127, 128, 129 are provided in the screw cap assembly. The aperture 128 permits gas flow in and out of the bottle 102 so as to manage pressure adjustment in the bottle 102. The apertures 127, 129 are configured to receive corresponding protrusions 127A, 129A in the valve assembly 106 so as to prevent or impede rotation of the valve assembly 106 as the dispensing cap assembly 104 is secured to the bottle 102. The aperture 128 is generally configured to admit air to the bottle 102.

With reference to the exploded view of delivery system 100 of FIG. 2, the valve assembly 106 is situated between the flexible bottle 102 and the screw cap assembly 104. The valve assembly 106 comprises a disc-shaped platform 200, an exit valve 202 configured to extend into the screw cap assembly 104 and an input valve 204 configured to extend into the bottle 102. The disc-shaped platform 200 may be sized to substantially match the size of the opening of mouth 116, so that platform 200 is secured to the mouth 116 of bottle 102 preferably forming a seal between the bottle 102 and the screw cap assembly 102. The platform 200 preferably is formed of an elastic material so as to serve as a compliant gasket.

Figure 3:
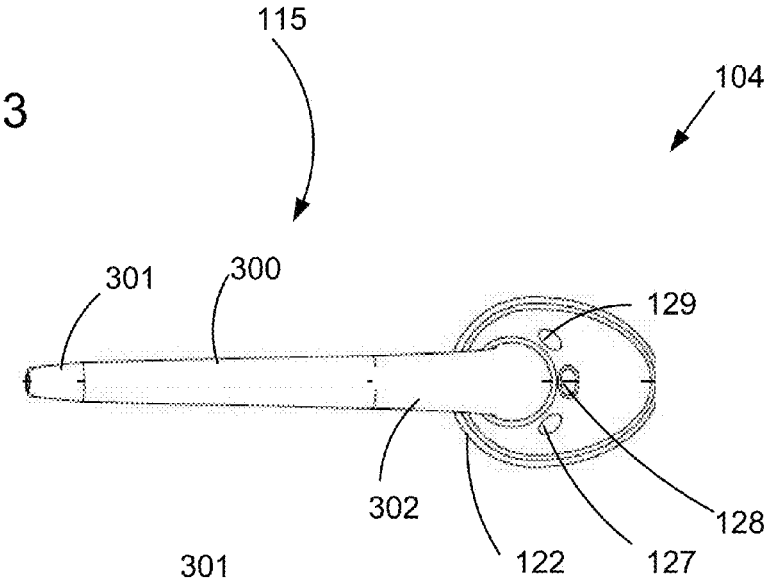
FIG. 3 is a top plan view of the dispensing screw cap assembly shown in FIGS. 1-2.
Figure 4:
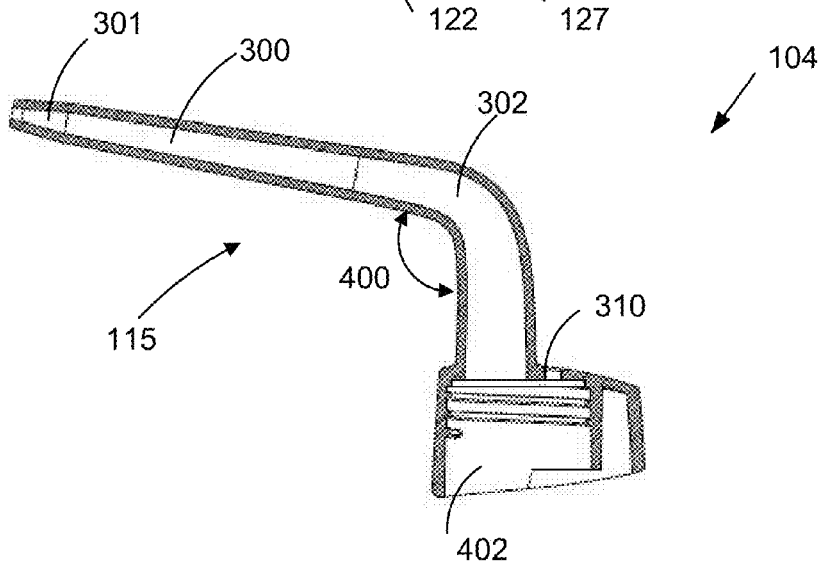
FIG. 4 is a side elevation view of the dispensing screw cap assembly shown in FIGS. 1-3.
Figure 5:
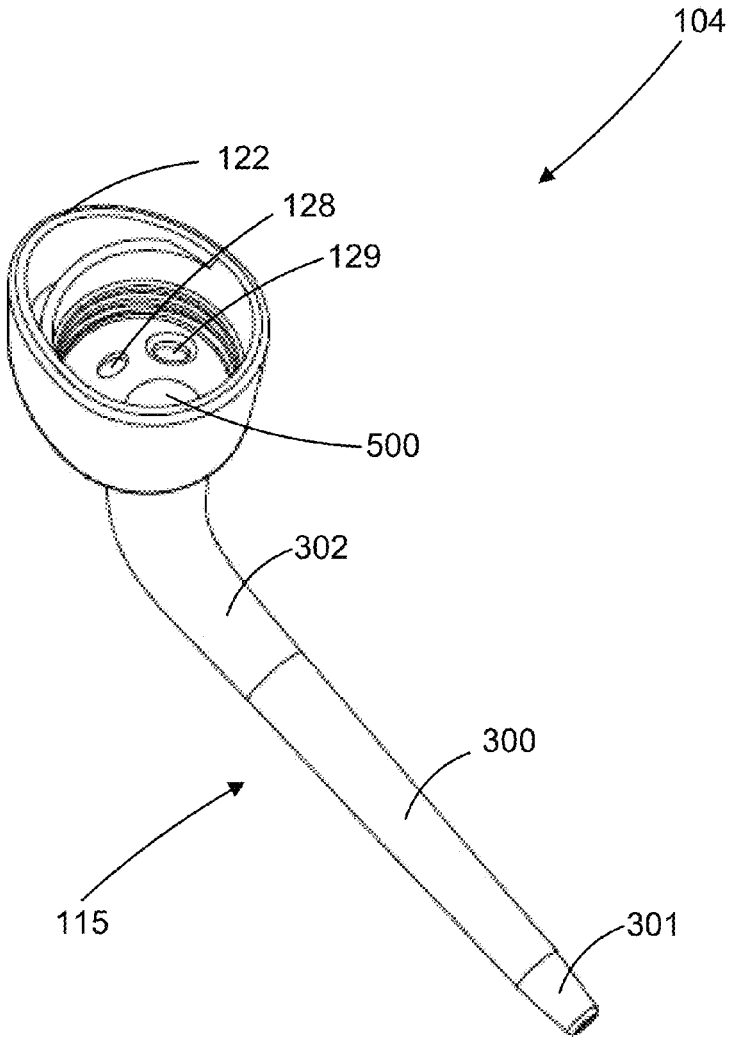
FIG. 5 is a bottom perspective view of the dispensing screw cap assembly shown in FIGS. 1-4.

FIGS. 3-5 illustrate additional features of the screw cap assembly 104. In the top plan view shown in FIG. 3, the shape of the outer perimeter 122 is visible, as are the positions of the aperture 128 that is provided to admit air or other gas into the bottle 102 when the bottle recovers from compression. The aperture 128 is situated to be coupled to the input valve 204 and the apertures 127, 129 are configured to receive protrusions 127A, 129A on the valve assembly. The screw cap assembly 104 preferably includes tapered nozzle 115 as a fixed portion of the assembly, and the nozzle 115 typically includes a tapered segment 300, a tip segment 301, and an elbow segment 302. As shown in FIG. 4, the elbow segment 302 is preferably bent at an elbow angle 400 that exceeds 90 degrees so that, when the delivery system 100 is held upright, hair colorant or other product can be dispensed in a convenient direction. For delivery of hair colorant products, horizontal delivery or delivery at a slight upward angle with respect to horizontal is convenient. Typical upward angles from the horizontal are in ranges from 0 degrees to about 30 degrees, such as 0 to 30 degrees, 0 to 10 degrees, or 0 to 5 degrees. The elbow angle 400 can be selected so that an upward delivery angle of 5-45 degrees is provided with the bottle 102 held upright. This arrangement permits convenient dispensing.

The sectional view of FIG. 4 shows the interior structure of the screw cap assembly 104, specifically, the degree of taper along the length of nozzle 115, and the degree of taper within the tip segment 301, where hair colorant product or other materials exit the delivery system 100 for application to a target area. The screw cap assembly 104 includes a hollow space 402 for receiving the threaded mouth 116 of the bottle 102. Referring to the bottom perspective view of FIG. 5, the screw cap assembly 104 also includes an aperture 500 at which elbow segment 302 joins screw cap assembly 104 and configured to receive the exit valve 202.

Figure 6:
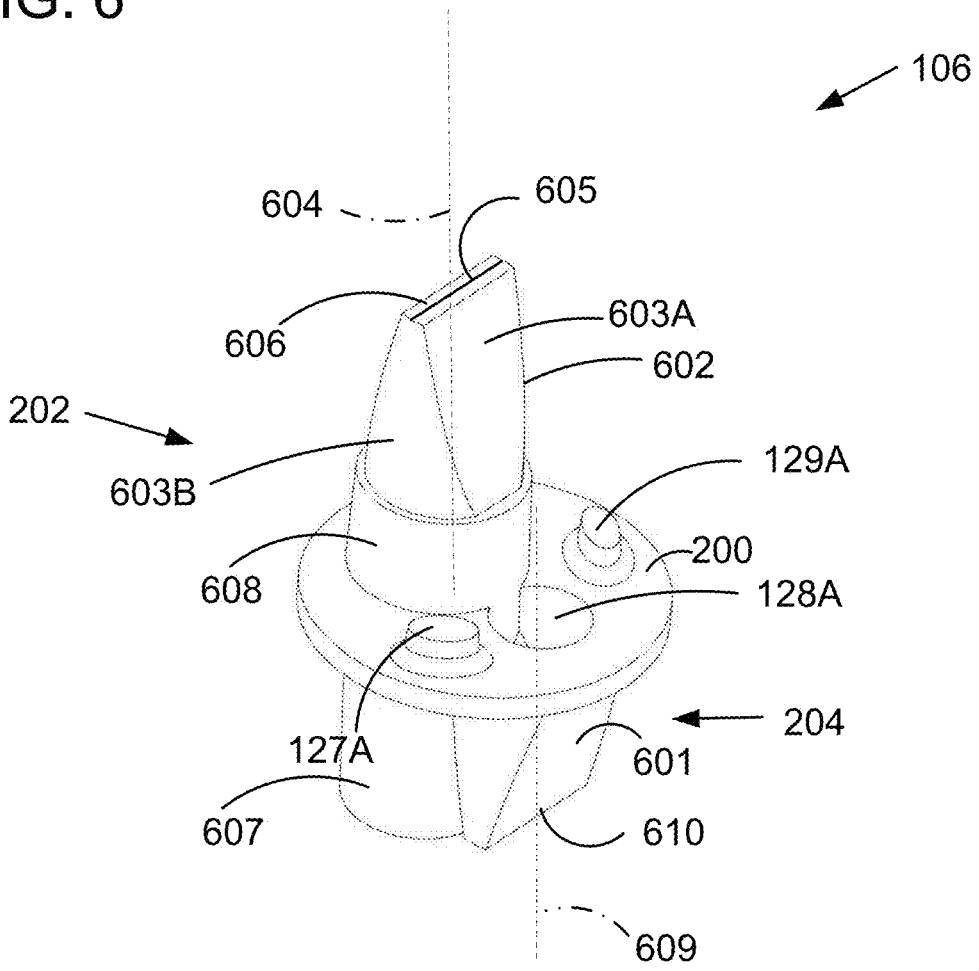
FIG. 6 is a perspective view of the asymmetric, bi-directional valve assembly shown in FIGS. 1-2.

A magnified perspective view in FIG. 6 illustrates details of a representative embodiment of the asymmetric bi-directional valve assembly 106. Each of the two valves, exit valve 202 and input valve 204, is formed by an aperture in platform 200 and a corresponding tapered extension. For example, the input valve 204 is formed by the intake aperture 128 and an inward tapered extension 601, and the exit valve 202 is formed by an exit aperture (not visible in the view of FIG. 6) and an outward tapered extension 602. The exit valve 202 includes an outward tapered extension 602 that extends along a first axis 604 to linear end slit 605 in an exit surface 606. The exit surface 606 is configured to direct fluid from the hollow tube 108 into the tapered nozzle 115. The slit 605 is configured to open in response to a positive pressure applied to the interior of the exit valve 202 and otherwise to remain substantially closed. Typically, the exit valve 202 is formed of a flexible, elastic material that is responsive to slight pressure provided by compression of the bottle 102. A lower portion 607 of exit valve 202 is configured to attach snugly to the proximal (top) end 107 of the tube 108. The exit valve 202 also includes a reinforcing collar 608 that extends outward form the platform 202 and is coupled to the outward tapered extension 602.

As shown in FIG. 6, the tapered extension 602 of the exit valve 202 includes opposing flat surfaces such as surface 603A and curved or cylindrical surfaces such as surface 603B. Surfaces such as the surface 603A generally taper from the platform 200 to the exit surface 605 so that the exit surface 605 is approximately rectangular. Curved surfaces such as the surface 603B can be similarly tapered. A taper angle and overall length of the tapered extension 602 can be selected as convenient, and generally so as to be accommodated by the elbow segment 302 of the nozzle 115. If desired, an external diameter of the reinforcing collar 608 is selected to seal to the nozzle 115 as secured to the bottle 102.

Similarly, the input valve 204 is typically configured to admit air from outside the bottle 102 via the air intake channel 600 through an inward tapered extension 601 that extends along and is tapered with respect to a second axis 609 which is offset from the first axis 604. The axes 609 and 604 are typically but not necessarily parallel. Accordingly, the tapered extensions 601 and 602 are generally oppositely directed, but they need not be anti-parallel. Entry of air into the bottle 102 through the narrow linear end slit 608 tends to equalize internal and external air pressures exerted on bottle 102, and maintains a headspace above the fluid reservoir within bottle 102. To prevent or reduce twisting or rotation of valve assembly 106 in the attachment of the screw top assembly 104 to the bottle 102, the valve assembly 106 includes the protrusions 127A, 129A that are configured to be inserted into corresponding apertures 127, 129 in the screw top assembly 104. The valve assembly 106 is preferably made of silicone or of a similar flexible elastic, chemically inert material. In some examples, the valve assembly is formed as a single piece in a molding or other process. Alternatively, input and exit valves and a suitable gasket platform can be formed separately, and retained in a suitable configuration as attached to a bottle. Input and exit valves can have the same dimensions, or can be different. Typically, neither of the valves is centered with respect to an axis of the bottle as assembled, but, if convenient, an input or exit valve can be centered.

Figure 7:
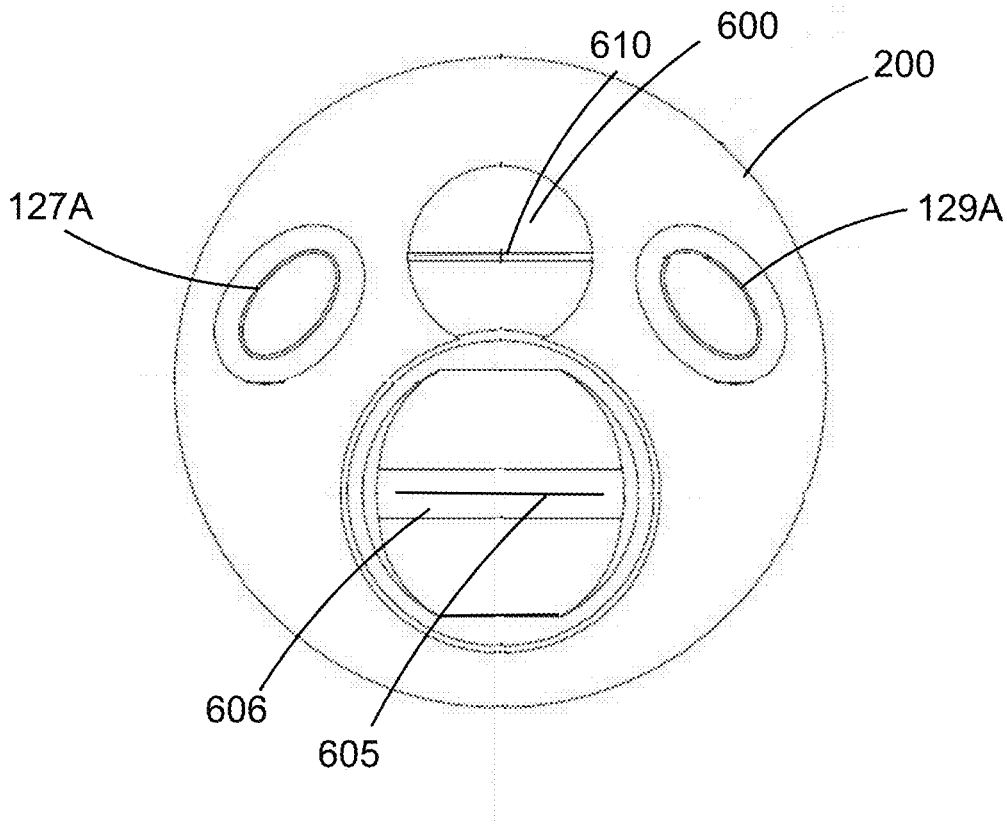
FIG. 7 is a bottom plan view of the asymmetric bi-directional valve assembly shown in FIG. 6.

In FIG. 7, a bottom plan view is presented, showing the various openings in the underside of disc-shaped platform 200 that supports the valve assembly 106. The orientation of slits 605 and 610 is understood to be substantially parallel in this representative example. An air intake channel 600 may have a different circumference than the circumference of the base of tapered extension 202.

Figure 8:
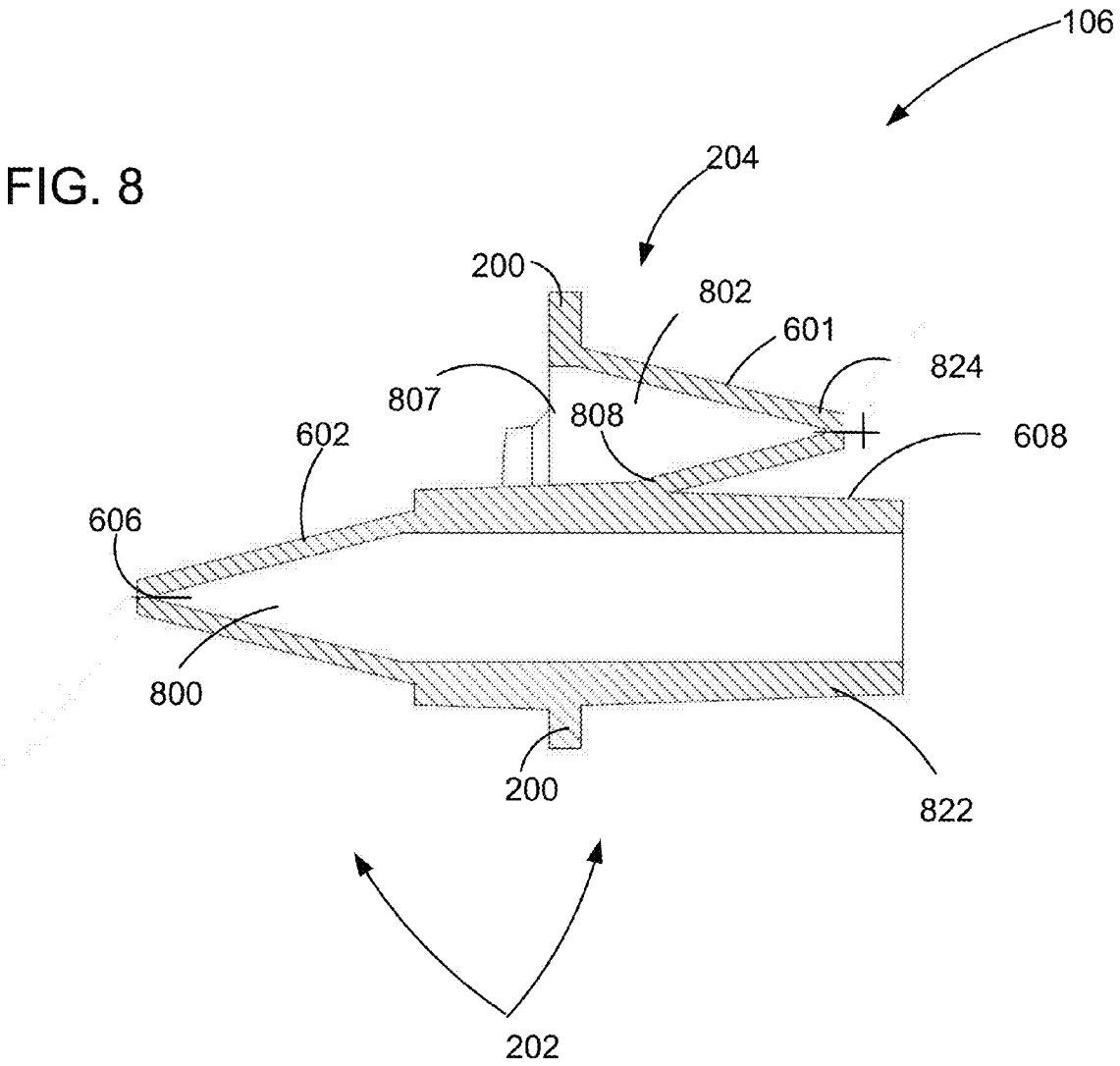
FIG. 8 is a schematic cross-sectional view of the asymmetric bi-directional valve assembly shown in FIGS. 6-7.

Referring to FIG. 8, a cross-section of valve assembly 106 is shown, highlighting further structural asymmetries between exit valve 202 and input valve 204. FIG. 8 shows internal dimensions of the valves 202 and 204 relative to a first tip cavity 800 and a second tip cavity 802, respectively, that comprise valve passageways through which fluids such as hair colorants or gases such as air move in response to compression and relaxation of the bottle 102. The volume of the tip cavities 800, 802 can be based on desired dispense pressures or volumes, bottle sizes, or different dispense material viscosities. According to one embodiment, walls 822, 824 of the valves 202, 204, respectively, meet at a junction 808, the location of which does not coincide with the platform 200. As shown in FIG. 8, the thickness of the wall 822 of the valve 202 at the reinforcing collar 608 is preferably greater than that a thickness of the wall 824 of the valve 204. The thickness of the wall 822 of the valve 202 at the reinforcing collar 608 is generally non-uniform, tapering so as to become thinner from the junction 808 in both directions. The reinforcing collar 608 also elevates the base of the outward tapered extension 602 of the valve 202 above the platform 200 whereas the location of the base of inward tapered extension 601 of the valve 204 coincides with platform 200.

Figure 9:
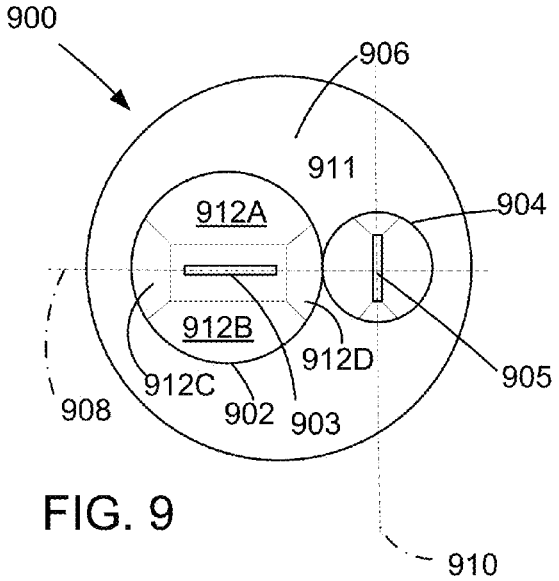
FIG. 9 is a bottom plan view of a representative asymmetric bi-directional valve assembly in which end slits of opposing outward and inward tapered extensions are perpendicular with respect to one another.
Figure 10:
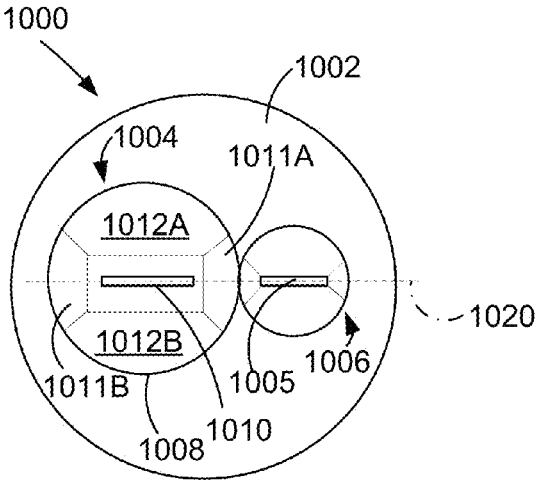
FIG. 10 is a bottom plan view of a representative asymmetric bi-directional valve assembly in which end slits of opposing outward and inward tapered extensions are parallel and along a common axis.

In general, valve assemblies may include a pair of opposing tapered extensions of arbitrary relative orientation. Referring to FIGS. 9-10, additional exemplary alternative embodiments of valve assemblies are shown in which pairs of opposing tapered extensions have different orientations. For example, according to one alternative embodiment shown in FIG. 9, a valve assembly 900 includes a first valve 902 and second valve 904 that include slits 903, 905, respectively, that are configured to control fluid flow. The slits 903, 905 extend along perpendicular axes 908 and 910, respectively. The valves 902, 904 extend from a compliant platform 906 that can serve as a gasket. The valve 902 includes a tapered extension 912 having flat surfaces 912A, 912B that taper from the platform 906 to the slit 903 and curved tapered surfaces 912C, 912D. The valve 904 can be similarly constructed, and the valve assembly 900 can be formed as a single molded part, or constructed of separated valves and gasket.

An alternative representative valve assembly 1000 is illustrated in FIG. 10. The valve assembly includes a gasket base 1002 configured to provide a seal between a color bottle and dispensing cap. Valves 1004, 1006 are provided for delivery of a product such as a hair color product from the bottle and admission of air to the bottle. The valve 1004 includes a tapered portion 1008 having an approximately circular cross section at the gasket base and a substantially rectangular cross-sectional area at an exit surface 1010. In some examples, portions of tapered extensions that define valves retain some curvature at the exit surface. For convenience, surfaces such as the exit surface 1010 are referred to as substantially rectangular as any curvature in shorter sides increase surface perimeter by less than about 20%, 10%, or 5% and when viewed, tend to appear rectangular.

As shown in FIG. 10, sidewall sections 1011A-1011B of the valve 1004 correspond approximately to portions of a conical surface, while sidewall sections 1012A-1012B are defined by flat surfaces that taper to the exit surface 1010. The sidewall sections 1011A-1012B can be formed of a flexible material having a constant or variable thickness, and are conveniently formed in a molding process that includes formation of the gasket base 1002. The valve 1006 can be similarly constructed, and in the example of FIG. 10, includes an exit slit and exit surface 1005 situated along a common axis 1020 with the exit surface 1010. For convenient illustration, exit slits in the valve exit surfaces are not shown in FIG. 10. Typically two valves and the gasket base 1002 are formed as a single molded part, but one or more or all can be formed separately by a molding or other fabrication process and secured as needed.

Slits in the exit surfaces 1010, 1005 permit fluid passage in response to a pressure difference between a pressure at the gasket base and at the exit surfaces. The valves are formed of a suitable flexible, elastic material so that such a pressure difference causes the slit to open and then to close when the pressure difference is removed. A slit length and exit surface area can be selected so as to permit ready delivery of a hair color product or other material in response to pressures available upon hand compression of a squeeze bottle. The valve assembly 1000 can also include a cylindrical extension (not shown in FIG. 10) that is configured for coupling to a tube that extends into a bottle to receive a hair color or other product. However, such an extension can be omitted, and the tube coupled directly to the gasket base 1002.

The representative valve assembly 1000 is shown as a flattened, cylindrical taper, but other shapes can be used. For example, a conical taper can be used, and a circular exit surface can be provided with a rectangular slit for fluid passage. Other exit surface treatments can also be used in which exit surface can provide an aperture for fluid passage in response to pressure and remain sealed in the absence of pressure. In addition, a slit or other prospective exit surface opening need not be centered in the exit aperture, and the exit aperture need not be centered with respect to an input aperture.

As shown in the examples, the bottle cap and a delivery tube are of one piece, unitary construction, but other arrangements can be used. For example, a bottle cap can be provided with one or more apertures to be fluidically coupled to a delivery tube that is provided as a separate part and, for example, retained against the gasket when the cap is secured to the bottle.

In the examples above, fluid delivery is via a rectangular slit aligned on a rectangular exit surface, but in other examples, exit slits can be provided on circular, ovoid, polygonal exit surfaces or exit surfaces of other shapes.

Figure 11:
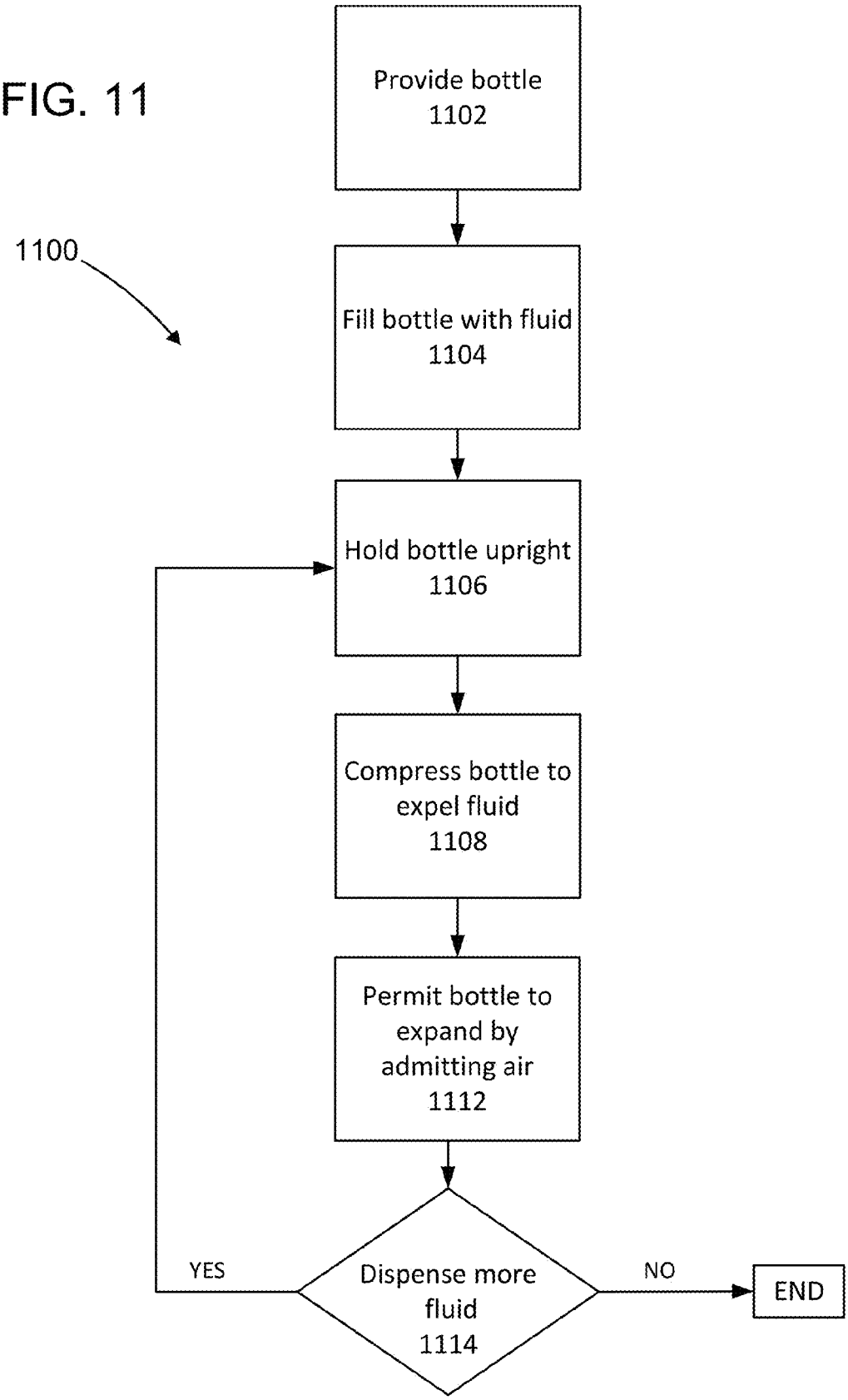
FIG. 11 is a flow diagram showing steps in a method of substantially continuous delivery of fluid to a target area.

With reference to FIG. 11, a representative method 1100 by which a user may achieve substantially continuous delivery of a fluid to a target area includes a step 1102 in which a flexible bottle is provided. In a step 1104, the bottle is at least partially filled with a fluid to be dispensed. At 1106, a user positions the bottle so that a fluid delivery nozzle tip is situated at a suitable location (for example, a location at which hair colorant is to be applied). The bottle can be held substantially upright and external pressure is applied to the bottle at 1108 so as to expel fluid from the bottle. At 1112, pressure can be released from the bottle so as to admit air into the bottle while retaining the fluid to be dispensed in the fluid delivery nozzle, even at the tip of the nozzle. If additional fluid such as hair colorant is to be applied, steps 1106-1112 can be repeated until the supply of fluid is exhausted or until selected areas are treated. The method 1100 applies generally to delivery of a fluid to a target area, for example, as an improvement in applications in which conventional squeeze bottles are used (e.g., food service, laboratory chemical use, and the like). In a specific example, the method 1100 provides steps by which a consumer can safely and effectively apply hair colorant with uniform delivery of a coloring agent without having to refill a dispensing nozzle every time a bottle is fully compressed and is allowed to return to its uncompressed shape.

In view of the many possible embodiments to which the principles of the disclosure may be applied, it should be recognized that the illustrated embodiments are only preferred examples and should not be taken as limiting the scope of the disclosure. We therefore claim all that comes within the scope and spirit of the appended claims.

We claim:

1. A hair color delivery system, comprising:

a flexible bottle;

a cap secured to a mouth of the flexible bottle;

a bi-directional valve assembly situated between the flexible bottle and the cap and secured to the bottle by the cap, the bi-directional valve assembly including:

an input valve defining an input slit, the input valve extending from a first planar surface of a gasket base and including a tapered extension that extends to an entrance surface containing the input slit, thereby defining an input aperture, and an exit valve defining an exit slit, the exit valve extending from a second planar surface of the gasket base in a direction opposite to that of the input valve and including a tapered extension that extends to an exit surface containing the exit slit, thereby defining an output aperture, wherein the first and second planar surfaces are opposing surfaces of the gasket base, and wherein the exit valve is operable in response to pressure in the flexible bottle; and a delivery tube having a proximal end coupled to the output aperture of the exit valve and a distal end that extends into the flexible bottle; wherein the cap includes a nozzle fluidically coupled to the proximal end of the delivery tube by the exit valve.

2. The hair color delivery system of claim 1, wherein the nozzle is tapered.

3. The hair color delivery system of claim 2, wherein the tapered nozzle includes an elbow portion and a delivery tube extending to a nozzle tip, wherein the elbow portion includes an elbow angle such that the delivery tube is tilted upwards from horizontal with the bottle in an upright position.

4. The hair color delivery system of claim 1, wherein the input valve extends into the bottle and the exit valve extends into the cap.

5. The hair color delivery system of claim 4, wherein the input valve and the exit valve extend along offset axes.

6. The hair color delivery system of claim 1, wherein the tapered extension of the exit valve includes opposing tapered flat surfaces that terminate at the exit surface, wherein the exit surface is substantially rectangular.

7. The hair color delivery system of claim 1, wherein the tapered extension of the input valve includes opposing tapered flat surfaces that terminate at the entrance surface.

8. The hair color delivery system of claim 1, wherein the bi-directional valve assembly is of unitary construction of a flexible material.

9. A method of substantially continuous delivery of a fluid to a target area, the method comprising:

providing a flexible bottle;

at least partially filling the flexible bottle with the fluid;

covering an opening of the flexible bottle with an asymmetric bi-directional valve assembly, comprising:

an input valve defining an input slit, the input valve extending from a first planar surface of a gasket base and including a tapered extension that extends to an entrance surface containing the input slit, thereby defining an input aperture, and an exit valve defining an exit slit, the exit valve extending from a second planar surface of the gasket base in a direction opposite to that of the input valve and including a tapered extension that extends to an exit surface containing the exit slit, thereby defining an output aperture, wherein the first and second planar surfaces are opposing surfaces of the gasket base, and wherein the exit valve is operable in response to pressure in the flexible bottle;

covering the asymmetric bidirectional valve assembly with a cap including a nozzle fluidically coupled to the proximal end of the delivery tube by the exit valve;

securing the cap to the flexible bottle;

expelling fluid from the flexible bottle in response to application of external pressure on the flexible bottle by directing the fluid through the exit valve; and admitting air into the flexible bottle through the input valve so as to adjust internal and external pressures on the flexible bottle, thereby permitting the flexible bottle to at least partially recover from the compression, and maintaining fluid in the nozzle.

10. The method of claim 9, wherein the fluid is expelled with the bottle in an upright position.

11. The method of claim 9, wherein the fluid is expelled along an axis that is tilted upward at an angle of between 1 and 30 degrees from horizontal.

12. A fluid delivery system, comprising:

a flexible bottle;

a cap secured to a mouth of the flexible bottle and comprising at least one aperture;

an asymmetric bi-directional valve assembly situated between the flexible bottle and the cap and secured to the bottle by the cap, the asymmetric bidirectional valve assembly including:

a gasket base comprising at least one protrusion configured to impede rotation of the valve assembly and wherein the at least one protrusion is configured to be accepted by the at least one aperture of the cap;

an input valve defining an input slit, the input valve extending from a first planar surface of the gasket base and including a tapered extension that extends to an entrance surface containing the input slit, thereby defining an input aperture, and an exit valve defining an exit slit, the exit valve extending from a second planar surface of the gasket base in a direction opposite to that of the input valve and including a tapered extension that extends to an exit surface containing the exit slit, thereby defining an output aperture, wherein the first and second planar surfaces are opposing surfaces of the gasket base, and wherein the asymmetric bi-directional valve assembly is of unitary construction of a flexible material; and a delivery tube having a proximal end coupled to the output aperture of the exit valve and a distal end that extends into the flexible bottle; wherein the exit valve comprises an untapered section coupled to the tapered extension and further shares a wall common to the input valve and wherein the cap includes a nozzle fluidically coupled to the proximal end of the delivery tube by the exit valve.

13. The fluid delivery system of claim 12, wherein the input valve and the exit valve are responsive to a pressure in the flexible bottle.

14. The fluid delivery system of claim 13, wherein the exit valve is configured to deliver a hair color product from the flexible bottle in response to a pressure applied to the flexible bottle and the input valve is configured to admit air into the flexible bottle upon release of the pressure applied to the bottle, and wherein the exit valve is closed in response to release of the pressure applied to the flexible bottle and the input valve is configured to remain closed in response to the applied pressure.

* * * * *